US012607098B2

(12) United States Patent
Hurtado et al.

(10) Patent No.: US 12,607,098 B2
(45) Date of Patent: Apr. 21, 2026

(54) JUNCTION ORIENTING INTERFACE FOR A MULTILATERAL WELL

(71) Applicant: Schlumberger Technology Corporation, Sugar Land, TX (US)

(72) Inventors: Jose Francisco Hurtado, Rosharon, TX (US); Mikhail V. Gotlib, Rosharon, TX (US); Kjell Revheim, Bucharest (RO)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/259,291

(22) Filed: Jul. 3, 2025

(65) Prior Publication Data

US 2026/0009313 A1 Jan. 8, 2026

Related U.S. Application Data

(60) Provisional application No. 63/667,176, filed on Jul. 3, 2024.

(51) Int. Cl.
*E21B 41/00* (2006.01)
*E21B 23/01* (2006.01)

(52) U.S. Cl.
CPC ..... *E21B 41/0035* (2013.01); *E21B 23/01* (2013.01)

(58) Field of Classification Search
CPC ..... E21B 41/0035; E21B 23/01
See application file for complete search history.

(56) References Cited

U.S. PATENT DOCUMENTS

| | | | | |
|---|---|---|---|---|
| 9,771,758 | B2 | 9/2017 | Hurtado | |
| 2010/0059279 | A1* | 3/2010 | Saylor | E21B 23/12 175/45 |
| 2015/0047840 | A1* | 2/2015 | Hurtado | E21B 7/061 166/255.2 |

OTHER PUBLICATIONS

Budinski, K. G. et al., "Chapter 1—Identification of Different Types of Wear", Guide to Friction, Wear, and Erosion Testing, Oct. 19, 2007, pp. 1-15.
Budinski, K. G. et al., "Types of Friction and Friction Testing", Guide to Friction, Wear, and Erosion Testing, Oct. 19, 2007, pp. 95-111.

* cited by examiner

*Primary Examiner* — Kristyn A Hall
(74) *Attorney, Agent, or Firm* — Kyle R. Miiller

(57) ABSTRACT

An orienting interface for alignment of a profile feature with a window of a tubular for installation at a junction of a multilateral well. The interface includes the coupling of an orienting device that accommodates the profile with an anchoring segment of the tubular. This coupling takes place with fasteners through selectively aligned openings in each of the device and the segment. More specifically, the openings in the anchoring segment differ in number from that of the orienting device so as to prevent a tailored resolution for alignment between the profile and the window.

20 Claims, 8 Drawing Sheets

JUNCTION ORIENTING INTERFACE FOR A MULTILATERAL WELL

PRIORITY CLAIM/CROSS REFERENCE TO RELATED APPLICATION(S)

This Patent Document claims priority under 35 U.S.C. § 119 to U.S. Provisional App. Ser. No. 63/667,176, entitled "Improvements for Multilateral Completion Systems", filed on Jul. 3, 2024, which is incorporated herein by reference in its entirety.

BACKGROUND

Exploring, drilling and completing hydrocarbon and other wells are generally complicated, time consuming and ultimately very expensive endeavors. In recognition of these expenses, added emphasis has been placed on efficiencies associated with well completions and maintenance over the life of the well. Over the years, ever increasing well depths and sophisticated architecture have made reductions in time and effort spent in completions and maintenance operations of even greater focus.

In terms of architecture, cased wells often deviate into lateral segments, directing well branches through various regions of a downhole formation. Accordingly, installed completions equipment may be fairly complex and of uniquely configured parts, depending on the particular location and function to be served. Thus, proper delivery and installation of completions equipment becomes more complex and critical along with the more sophisticated architecture of a multilateral well. As used herein, the term "hardware" may be employed to describe completions equipment that is installed for long term placement in a well in contrast to other types of equipment such as tools that are utilized for delivery, positioning, intervention or other temporary applications in the well followed by a nearer term retrieval.

In recognition of the multilateral well complexity and importance of proper hardware installation, developments directed at ensuring proper hardware alignment during installation have emerged. In one example, multilateral junction hardware is installed in the vicinity of a multilateral leg or horizontal. More specifically, a casing, generally vertical in nature may have a milled or bored window from which a lateral leg may emerge to accommodate additional casing or a tubular offshoot from the main bore. The junction hardware is installed with precision to help facilitate further hardware installation from the main bore and into the lateral leg.

In order to assure that the additional hardware is properly guided through the window and into the lateral leg, the junction hardware is installed in a manner that assures follow-on hardware installation may reach the intended leg. This is generally accomplished by way of placing a tubular through the main bore that is equipped with a matching window to that of the main bore casing. In this way, follow-on completions hardware may be routed through to the lateral leg destination. Thus, in order to achieve the window alignment between the main bore and that of the tubular, an orienting device is coupled to the tubular in a manner that helps ensure and guide follow-on hardware through the aligned windows.

At present, securing of the orienting device to the tubular is achieved by a precisely tailored threading between the device and an anchoring segment at the top of the tubular. Unfortunately, achieving the precise threaded coupling of the orienting device to the anchoring segment of the tubular may be an expensive and time consuming endeavor to assure that the orienting device is properly aligned with the window of the tubular prior to installation. Further, the precision required is such that the orienting device is particular to the anchoring device and tubular without the option of pulling a standard, off-the-shelf, orienting device for use. That is, for each alignment, a custom crafted threading between the orienting device and the anchoring device is required for sake of ensuring proper alignment with the tubular window.

SUMMARY

An orienting interface is provided for installation of a junction in a multilateral well. The interface includes a anchoring segment above a lateral window of a tubular. This segment includes a plurality of first openings of a given number at a circumferential location of the segment. The interface also includes an orienting device coupled to the anchoring segment. The orienting device includes a feature aligned with the window of the tubular. This device also includes a plurality of second openings of a different number than the given number and at a circumferential location of the device. A plurality of fasteners are also provided for securing the orienting device to the anchoring segment through selectively aligned first and second openings to facilitate the alignment of the feature with the window.

DETAILED DESCRIPTION

Embodiments are described with reference to certain completion assemblies and manners of installation. In particular, a vertical well is referenced that includes at least one multilateral leg extending from a main bore. Thus, multilateral junction hardware is positioned at the junction of the main bore and the leg. However, other types of well architecture may take advantage of concepts detailed herein. For example, a cased well section of any orientation with a side branch emerging therefrom to render a multilateral well may include junction hardware as detailed herein, regardless of the particular architecture, orientation or number of branches. Indeed, so long as an orienting device is coupled to an anchoring segment of junction hardware through a plurality of differently numbered holes in each, appreciable benefit may be realized.

Figure 1:
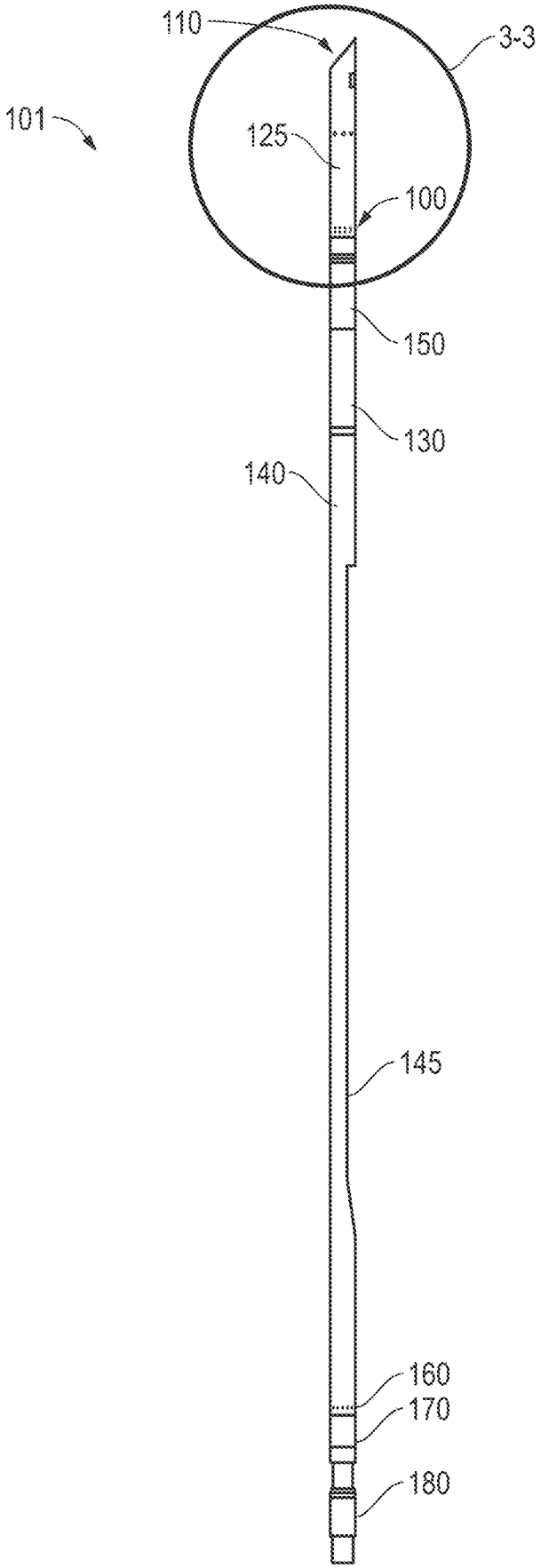
FIG. 1 is a side view of a tubular assembly for use with a multilateral well completion and including an orienting interface of selectively aligned openings.
Figure 2A:
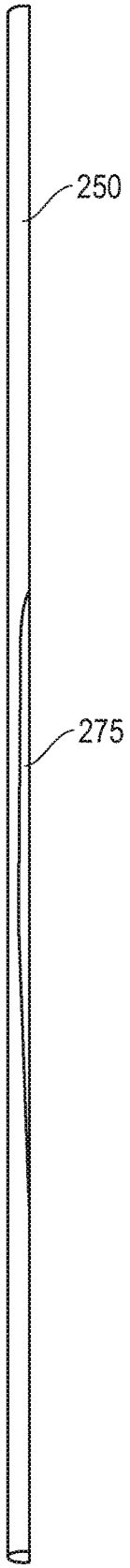
FIG. 2A is a side view of a casing for accommodating the tubular assembly of claim 1.
Figure 2B:
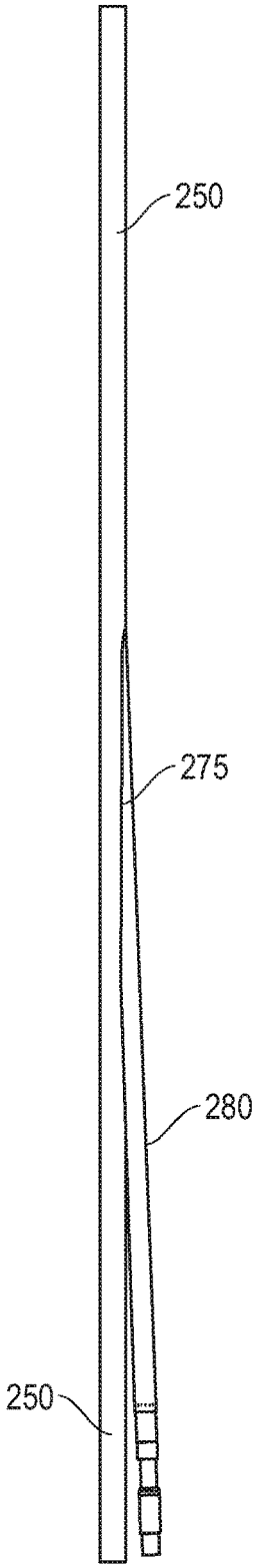
FIG. 2B is a side view of the casing of FIG. 2A with an emerging lateral bore therefrom facilitated by the tubular assembly of FIG. 1.

Referring now to FIG. 1, a side view of a tubular assembly 101 is shown for use with a multilateral well completion. For example, the assembly 101 may be configured for installation through a downhole casing 250 as shown in FIGS. 2A and 2B. The assembly 101 may include a standard tubular 140 with a coupling 130 for securing hardware there above and a stub 160 for securing other hardware below (e.g. a sub 170 and tension lock swivel 180). Continuing with added reference to FIGS. 2A and 2B, the tubular assembly 101 also includes a tubular window 145 that is configured to align with a casing window 275 at a multilateral junction downhole in a well. The assembly 101 and window 145 may serve to help guide and facilitate lateral bore hardware 280 into a lateral deviation from within the main bore as specifically illustrated in FIG. 2B. Of course, in order for this to occur, the assembly window 145 and the casing window 275 should be substantially aligned with one another.

In order to help ensure the noted window alignment, the embodiment of FIG. 1 includes an orienting device 125 that is secured to the tubular 140 structure of the assembly 101 in advance of downhole installation. The orienting device 125 includes a mule profile 110 that presents the appearance of a peak that, once secured to the tubular 140, is in alignment with the tubular window 145. A mule profile or mule shoe is a feature that is often employed to guide tubulars or other completions equipment into position during installation. Thus, its inclusion with the orienting device 125 may be strategically beneficial beyond the orientation application as detailed herein.

Regardless, continuing with added reference to FIGS. 2A and 2B, once installed with the assembly 101 in the main bore casing 250, this profile 110 is configured to accommodate and align other hardware as it is subsequently deployed, and potentially routed to the lateral bore 280. Because the profile 110 is aligned with the tubular window 145 which is aligned with the casing window 275, the described deployment may proceed in a manner that is not blind to the aligned windows 145, 275. More specifically, once hardware engages with the installed profile 110, orientation information is available and maneuvering may proceed in a sighted manner to the aligned windows 145, 275 or elsewhere, depending on the installation application at hand.

For the embodiment shown, alignment of the orienting device 125 and profile 110 with the tubular window 145 takes place at an orienting interface 100. More specifically, the orienting device 125 is uniquely secured to an anchoring segment 150 above a coupling 130 of the tubular 140. Rather than utilizing a threaded interface, the orienting interface 100 employs strategically aligned openings 300, 350 that accommodate fasteners 375 to ensure adequate coupling. In this way, precision threaded coupling, which is both more costly and less flexible in terms of off-the-shelf application, may be avoided (see FIG. 3B).

Figure 3A:
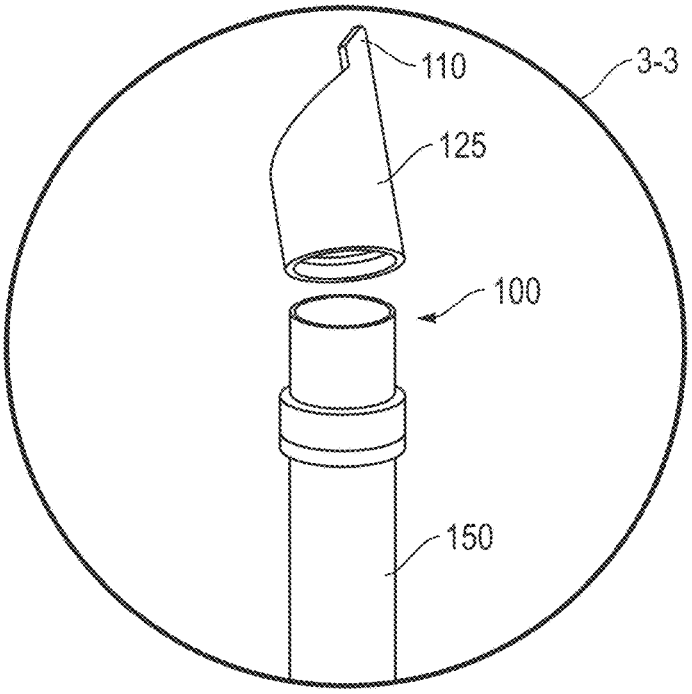
FIG. 3A is a side perspective and exploded view of the orienting interface of FIG. 1 highlighting an orienting device for coupling to an anchoring segment of the tubular assembly.

Continuing now with specific reference to FIG. 3A, a side perspective and exploded view of the orienting interface 100 is shown taken from 3-3 of FIG. 1. This view highlights the orienting device 125 as it presents adjacently over the anchoring segment. However, as noted above, the coupling of the device 125 to the anchoring segment 150 is not necessarily threaded. Instead, a secure interface 100 is achieved through selectively aligned openings 300, 350 (see FIG. 3B). Further, for embodiments where threading between the device 125 and segment 150 is employed, it is not required to be a timed threading with any necessary degree of precision (e.g. in landing the device 125 at the segment 150). Instead, as noted, the openings 300, 350 are utilized as described below.

Figure 3B:
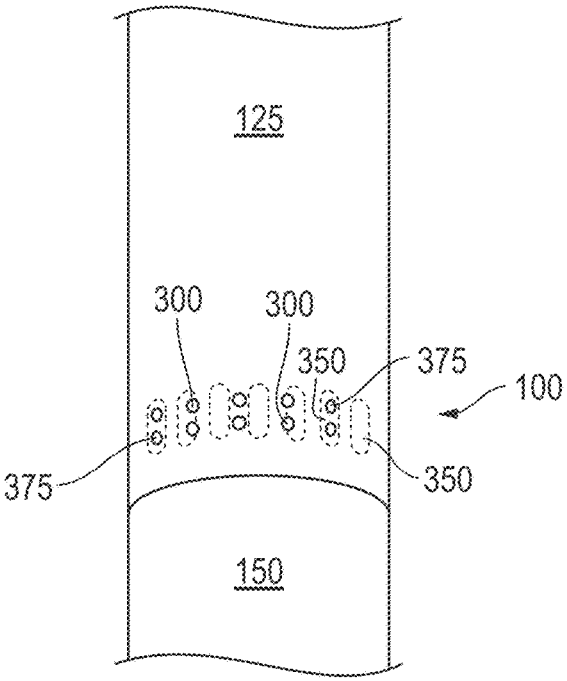
FIG. 3B is a side perspective view of the orienting interface of FIG. 3A with the orienting device coupled to the anchoring segment.

Referring to FIG. 3B, a side perspective view of the orienting interface 100 of FIG. 3A is shown with the orienting device 125 secured to the anchoring segment 150. Apart from orientation and alignment aspects noted herein, the security of this coupling may resist torque loads between the orienting device 125 and the remainder of the assembly 101 of FIG. 1.

Continuing with reference to FIG. 3B, orienting device openings 300 are apparent in the device 125 and anchoring segment openings 350 apparent in the segment 150 under the orienting device 125 (note the dashed illustration). In the embodiment shown, the orienting device openings 300 are threaded holes for receiving fasteners 375 in the form of set screws. The underlying anchoring segment openings 350 are slot shaped and, where aligned with a pair of orienting device openings 300, are able to matchingly secure a pair of set screws 375 for securely retaining the orientating device 125. Of course, a variety of different opening types and fasteners may be utilized. For example, the morphology of a slot might be employed at the orienting device 125 with threaded hole morphology found at the anchoring segment 150, whether or not presented in pairs. Further, slots and threaded holes may be avoided altogether. So long as opening locations are utilized as described herein, appreciable benefit may be realized. It is of note that while slots and circular holes may be typically employed, oval, square, rectangular or any number of various morphologies may be employed in defining the openings 300, 350.

Notice, however, that not all of the device openings 300 are aligned with all of the segment openings 350. For the illustration shown, alignment occurs at four total circumferential locations of the interface 100, 90° apart from each other (two of which are visible from the side view shown). These are the locations where pairs of set screws 375 have been installed to secure the orientating device 125 on the anchoring segment 150. In this embodiment, there are 20 slots 350 circumferentially about the anchoring segment 150 but only 16 pairs of threaded holes 300 circumferentially about the orienting device 125 (22.5° apart from one another). In this manner a resolution of 4.5°. That is, with each component 125, 150 having a 360° radius and their openings 300 or 350 being equidistant circumferentially thereabout, the orienting device 125 will never have to rotate more than 4.5° in one direction or another to reach underlying opening alignment with the anchoring device 150. Recalling that the positioning and securing of the orienting device 125 is for sake of aligning the profile 110 with the tubular window 145, this means that the alignment never need be more than 4.5° away from precisely with the central axis of the window 145.

In the example described above, a 4.5° tolerance would be within conventional standards which are typically well more than 5°. However, adjustments may be made to further reduce the resolution to less than 4.5° by changing the opening numbers. So long as the opening numbers about the circumference of each component 125, 150 are different, a higher degree of resolution may be realized than when the opening numbers match.

Figure 4:
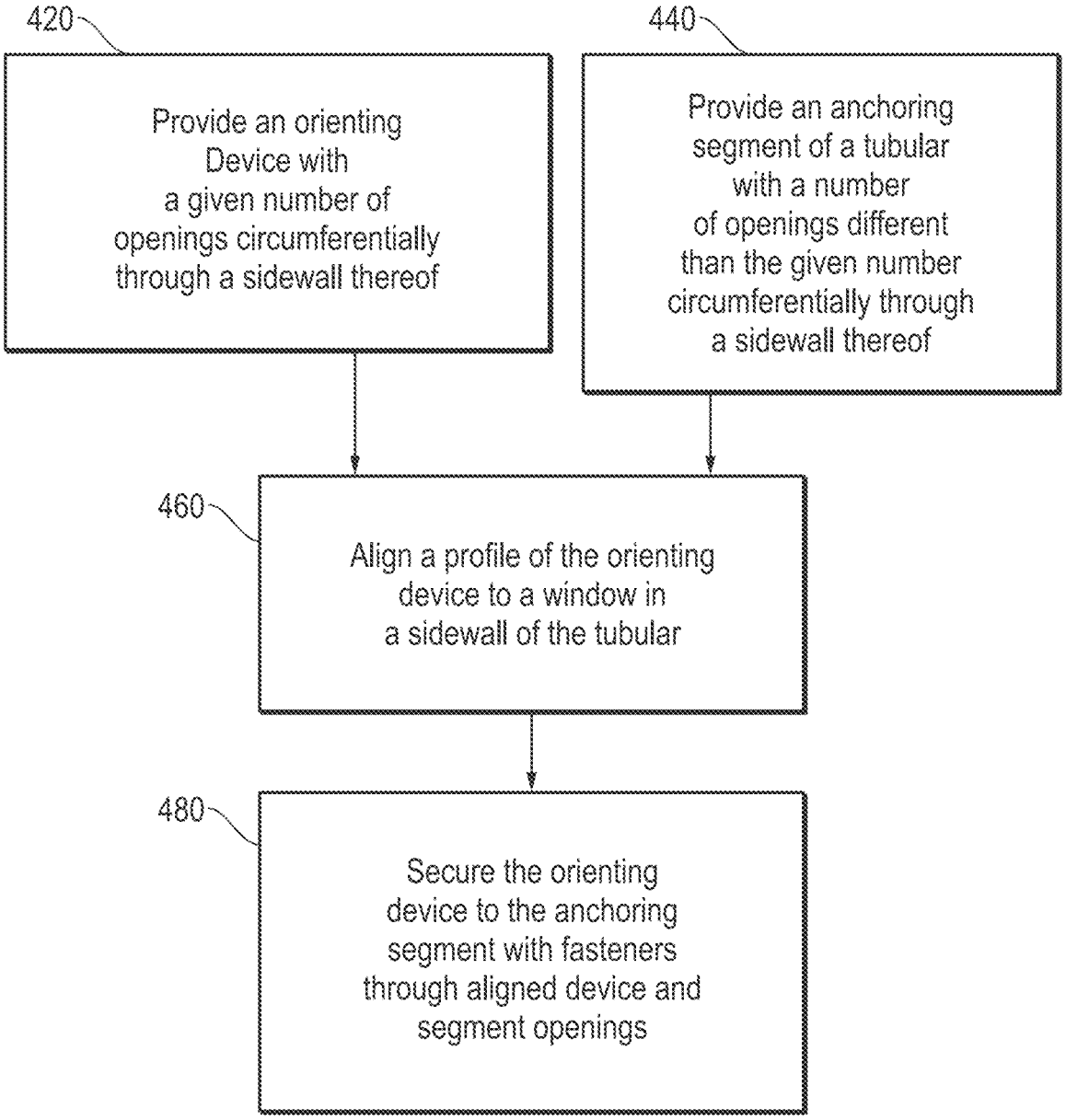
FIG. 4 is a flow-char summarizing an embodiment of securing an orienting interface to an anchoring segment of a tubular assembly for deployment to a multilateral through a multilateral well.

Referring now to FIG. 4, a flow-chart is shown summarizing an embodiment of securing an orienting device to an anchoring segment of a tubular assembly for deployment to a junction in a multilateral well. The method includes providing the anchoring segment and orienting device with each having circumferential openings at respective sidewalls (see 420, 440). More specifically, the openings at the sidewall of the anchoring segment differ in number from the openings at the sidewall of the orienting device.

The orienting device is placed over the anchoring segment which is secured to the junction hardware there below. As indicated at 460, the orienting device includes a profile that is aligned with a window of a tubular during this positioning. Due to the openings differing in number from one component to the next, placement of the orienting device over the anchoring segment allows for selective alignment of certain of the openings. Thus, as noted at 480, the orienting device may be secured to the anchoring segment with fasteners through the aligned openings of each component.

Figure 5:
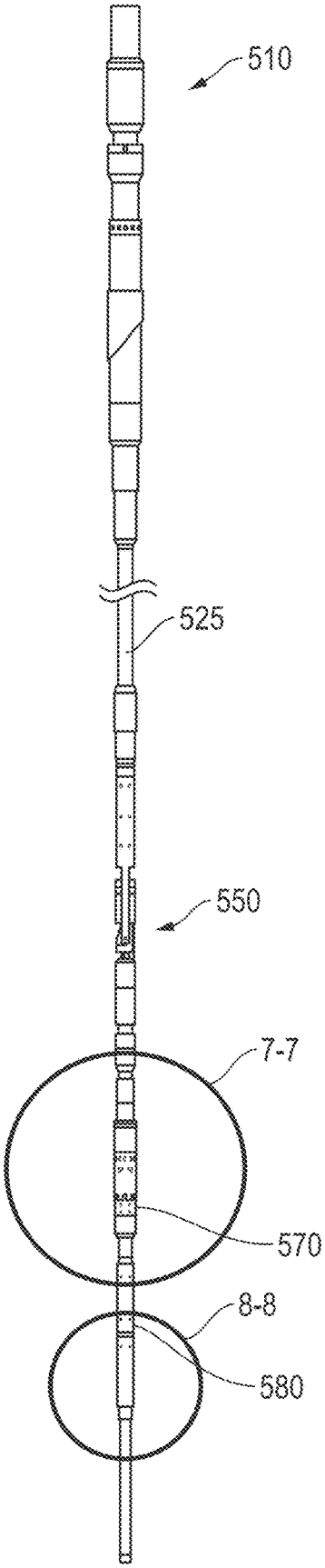
FIG. 5 is a side view of interior components for a tubular assembly configured for deployment through a multilateral well completion with a window finder, collet running tool and rotating ball seat segments.

Referring now to FIG. 5, a side view of an interior assembly is shown that is configured for deployment through a multilateral well completion. The depicted hardware includes a window finder 550, collet running tool 570 and rotating ball seat 580 segments. The assembly also includes an anchor setting tool 510 and a spacer 525 for alignment with an interior of other hardware such as the tubular assembly 101 shown in FIG. 1.

Figure 6:
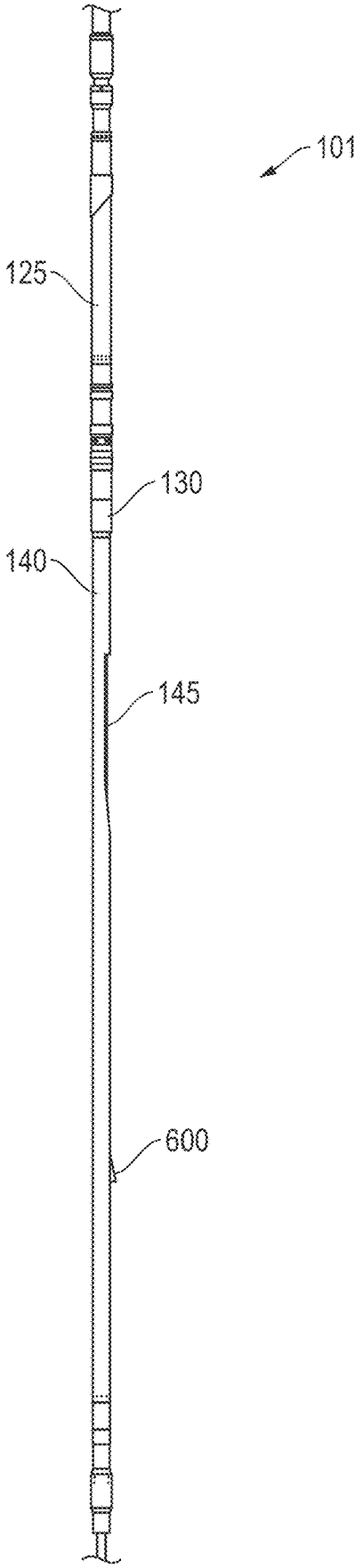
FIG. 6 is a side view of the tubular assembly of FIG. 5 with a deployed window finder hook.

Referring now to FIG. 6, a side view of a tubular assembly accommodating the interior assembly of FIG. 5 is shown with a deployed window finder hook 600. That is, an assembly 101 such as that of FIG. 1 may accommodate an interior assembly that is deployed through the tubular 140 until the window finder 550 of FIG. 5 is utilized to extend a hook 600 as illustrated in FIG. 6. The hook 600 is able to deploy once the window 145 is reached and subsequently lands at the bottom edge of the window, stabilizing the interior assembly in place for further operations.

Figure 7A:
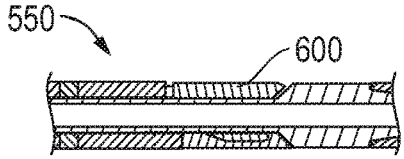
FIGS. 7A-7E are side views of a collet running tool segment for the assembly of FIG. 5.
Figure 7B:
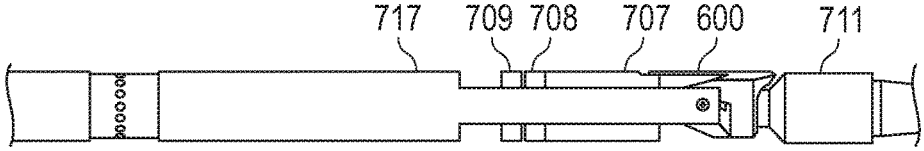
Figure 7C:
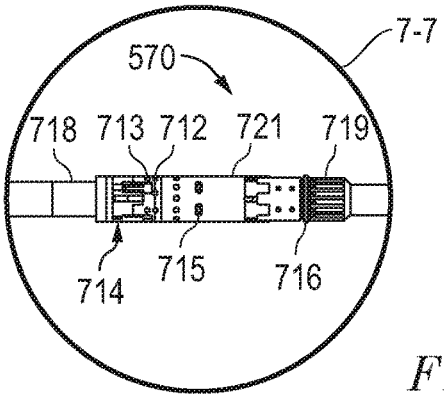
Figure 7D:
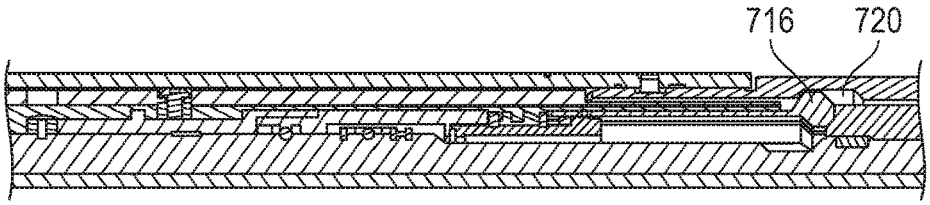

Referring now to FIGS. 7A-7E, side views of the collet running tool (CRT) segment 570 for the assembly of FIG. 5 are shown. Specifically, FIG. 7A illustrates the hook 600 at the interior of the window finder 550 prior to deployment. FIG. 7B shows features adjacent the hook 600, namely a lock block 707 and a mandrel 711 which are utilized for hook deployment (see FIG. 7E). This actuation is driven by the CRT 570 of FIG. 7C (taken from 7-7 of FIG. 5) and 7D.

In operation, prior to running deployment into a well, the collet 716 is latched in to a groove 720. When hydraulic release is actuated as described below with reference to FIGS. 8A and 8B, pressure is applied to break shear screws 715 and stroke an internal piston. In this manner, the collet 716 is pulled and collapses. When this mechanical release occurs, torque is applied to break shear screws 713 and rotate a torque busing 714 relative a torque sleeve 721. This rotation moves castellations on the busing 714 to a new position where axial displacement can be transmitted when sufficient weight is set down from an oilfield surface. Slacking off weight causes shear screws 712 to break which allows downward displacement of a mandrel 718 together with a lower sub 719. At this point the lower sub 719 no longer supports the collet 716 which can now collapse and release from the groove 720 as suggested above.

Figure 7E:
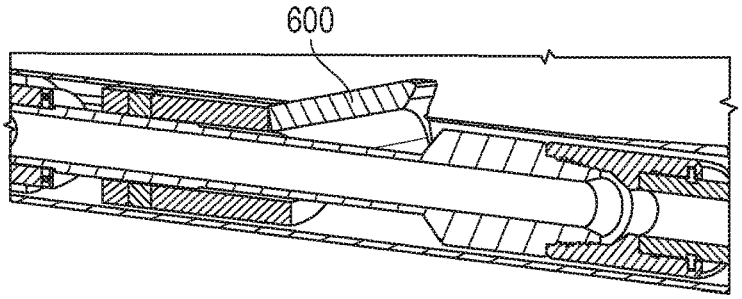

The window finder hook 600 is hinged to the block 707 which is installed and shear pinned over the mandrel 711. A set of splines rotationally locks the block 707 to the mandrel 711. Shear screws 709 resist axial movement and rotation of the block 707 relative to the mandrel 711. String pressure may be applied to push the cylinder 717 upwards which in turn raises the hook 600 via a cam-follower mechanism as shown in FIG. 7E. A wave spring 708 may be integrally machined on the block 707 to provide sufficient axial compliance/deformation to transmit an axial displacement to the CRT 570. Thus, the CRT 570 is placed in a state of compression.

In this state, the junction hardware is then deployed downhole. A lateral completion connected at the bottom of the junction is diverted into the lateral bore similar to the illustration at FIG. 2B. Before reaching the window 275, string pressure is applied to stroke cylinder 717 and extend the hook 600 as illustrated in FIG. 6. Once the junction is positioned and oriented properly, weight is slacked off to break shear screws 709 and displace block 707 upwards, which disengages splines as described above. A hydraulic packer attached to the top of the junction is then set. At this point, the running string is picked up to relieve any residual axial or torsional loading. Next the running string is released from the junction either hydraulically, or mechanically in a contingency.

When hydraulically releasing the junction, the CRT 570 is in compression for collet 716 to unload from groove 720. With the hook 600 still "catching" (i.e. loaded) against the bottom of the casing window, weight is slacked off from surface against block 707. This causes spring 708 to deform axially and transmit an axial displacement to the CRT 570. Such axial displacement is sufficient to unload the collet 716 from the groove 720. Once unloaded from the groove 720, the collet 716 freely collapses and releases when pressure is applied to the cylinder 717.

If the hydraulic release fails, a mechanical release becomes the backup or contingency procedure to follow. The string is rotated to the left to break shear screws on the window finder shear screws 713 on the CRT 570. This left-hand torque rotates the CRT's torque bushing 714 relative to torque sleeve 721. A gap between the block 707 and the cylinder 717 allows for sufficient axial stroke to push the mandrel 711 together with the CRT mandrel 718 downwards to complete the mechanical release.

Figure 8A:
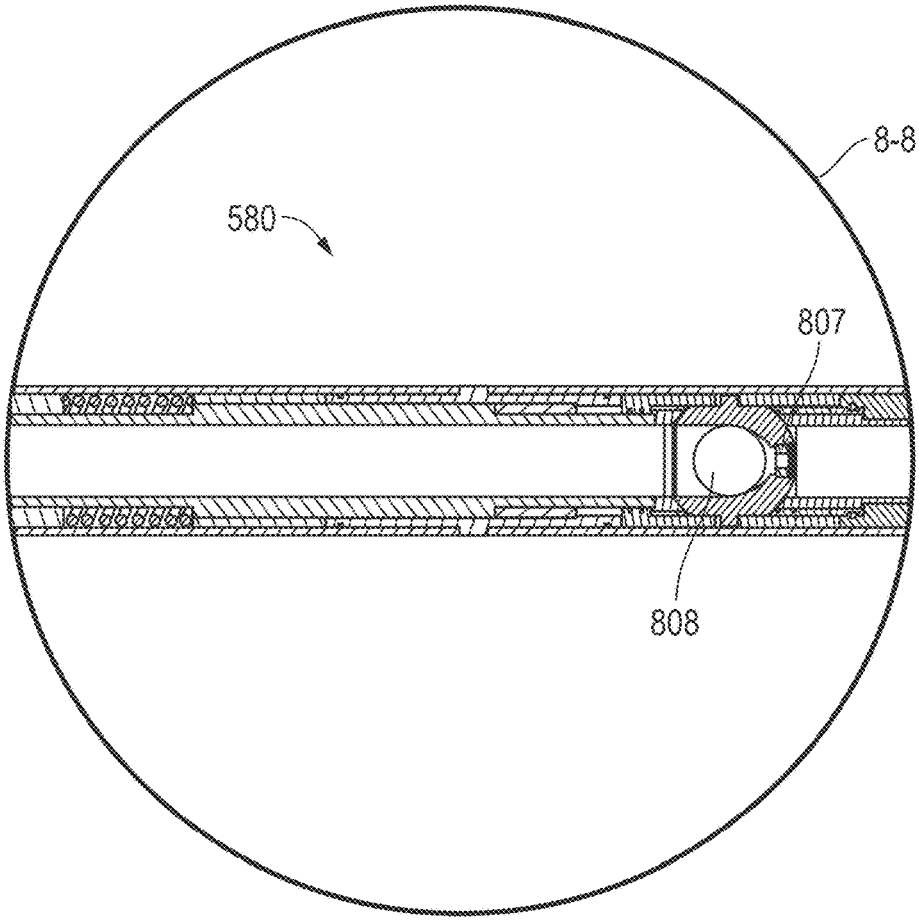
FIGS. 8A-8B are side cross-sectional views of a rotating ball seat segment for the assembly of FIG. 5.
Figure 8B:
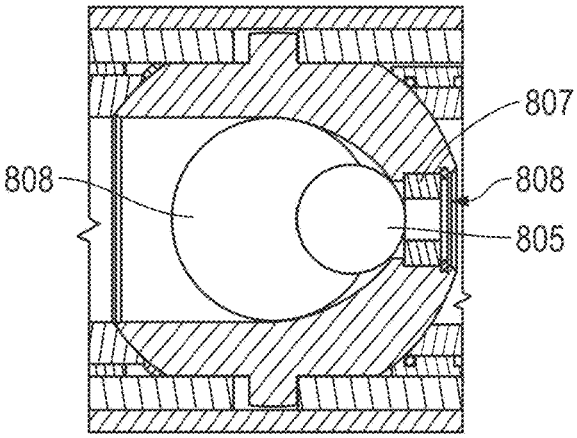

Referring now to FIGS. 8A-8B, side cross-sectional views of a rotating ball seat (RBS) segment 580 for the assembly of FIG. 5. To activate the window finder 550, the running string is pressured up, which is typically achieved by dropping a ball 805 from the surface to land on a ball seat within a rotating ball seat (RBS) assembly 580 positioned below the running string. However, in wells with unconsolidated formations, relying on the ball 805 to circulate down a lengthy drill string poses a risk of the ball getting stuck. Therefore, for the embodiment illustrated an alternative mode of actuation is provided which may be optionally used.

In one or more embodiments of the multilateral completion system, the RBS assembly 580 further comprises a restriction 807 which may be a carbide choke. The choke 807 is secured in place by a snap ring and serves to increase pressure in the running string by restricting the flow of fluid (e.g. through passage 808). The increase in pressure can be calculated based on the choke's inner diameter, flowrate, and fluid density. By pumping a predetermined flow rate, the string pressure can be raised to the level required for activating the window finder's hook 600. This provides an alternate method for activating the window finder and mitigates the risk of getting stuck, particularly in wells with unconsolidated formations. Additionally, chokes with various inner diameters may be produced to accommodate a range of activation flow rates. In one or more embodiments, the choke is constructed from a hard material, for example carbide, to minimize erosion.

Embodiments described hereinabove include the use of an orientation device that may be utilized to help assure proper alignment for installation of junction hardware in a multilateral well. The device and anchoring segment of the junction hardware are provided in a manner that avoids the requirement of precision threading and allows for the use of off-the-shelf components. This is achieved through the use of circumferential openings about the device and segment which differ in number for sake of strategic alignment and securing with fasteners The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Regardless, the foregoing description should not be read as pertaining only to the precise structures described and shown in the accompanying drawings, but rather should be read as consistent with and as support for the following claims, which are to have their fullest and fairest scope.

We claim:

1. An orienting interface for installation at a junction of a multilateral well, the interface comprising:

an anchoring segment above a lateral window of a tubular, the anchoring segment including a plurality of first openings of a given number about a circumference of the anchoring segment at a same longitudinal location along the anchoring segment;

an orienting device coupled to the anchoring segment with a feature aligned with the window of the tubular, the device including a plurality of second openings of a different number than the given number about a circumference of the orienting device at a same longitudinal location along the orienting device; and a plurality of fasteners for securing the orienting device to the anchoring segment through selectively aligned first and second openings to facilitate the alignment of the feature with the window.

2. The orienting interface of claim 1 wherein the feature is a mule profile.

3. The orienting interface of claim 1 wherein the securing of the orienting device to the anchoring segment presents resistance to torque loads between the orienting device and the tubular.

4. The orienting interface of claim 1 wherein the orienting interface is configured to be installed in the junction of the multilateral well such that the window of the tubular aligns with a window of a casing of the multilateral well.

5. The orienting interface of claim 1 wherein the first openings of the anchoring segment are of a slot configuration.

6. The orienting interface of claim 5 wherein the second openings of the orienting device are pairs of threaded orifices for accommodating the fasteners upon the selective alignment of the first openings and the second openings.

7. The orienting interface of claim 6 wherein the fasteners are set screws.

8. The orienting interface of claim 1 wherein the first openings of the anchoring segment are positioned at 20 different positions about the circumferential location thereof and the second openings of the orienting device are at 16 different positions about the circumferential location thereof.

9. The orienting interface of claim 8 wherein the positions at the anchoring segment are equidistant from one another and the positions at the orienting device are equidistant from one another, the selectively aligned first and second openings presenting an alignment resolution of no more than 4.5° between the feature of the orienting device and a central axis of the window.

10. A multilateral completions assembly comprising:

a main bore casing through a well and having a window exposed to a lateral bore;

a tubular assembly including a junction window aligned with the window of the casing, the tubular assembly including an orienting interface comprising:

an anchoring segment above the junction window with a plurality of first openings of a given number about a circumference of the anchoring segment at a same longitudinal location along the anchoring segment;

an orienting device coupled to the anchoring segment with a feature aligned with the junction window, the device including a plurality of second openings of a different number than the given number about a circumference of the orienting device at a same longitudinal location along the orienting device; and a plurality of fasteners for securing the orienting device to the anchoring segment through selectively aligned first and second openings to facilitate the alignment of the feature with the junction window.

11. The completions assembly of claim 10 further comprising lateral bore hardware through the aligned junction window and window of the casing and into the lateral bore.

12. The completions assembly of claim 10 wherein the alignment of the feature with a central axis of the junction window is within 4.5° of resolution.

13. The completions assembly of claim 12 wherein the alignment of the junction window and the window of the casing is within 4.5° of resolution.

14. A method of aligning a profile of an orienting device with a window in a tubular for installation at a junction of a multilateral well, the method comprising:

providing an anchoring segment of the tubular with a plurality of first openings of a given number about a circumference of the anchoring segment at a same longitudinal location along the anchoring segment;

placing the orienting device at the anchoring segment with a plurality of second openings of a number different than the given number about a circumference of the orienting device at a same longitudinal location along the orienting device;

aligning the profile of the orienting device to the window; and securing fasteners through selectively aligned first and second openings.

15. The method of claim 14 wherein the aligning of the profile of the orienting device to the window is to within 4.5° between the profile and a central axis of the window.

16. The method of claim 15 wherein the first openings of the anchoring segment are positioned at 20 different equidistant positions about the circumferential location of the anchoring segment and the second openings of the orienting device are at 16 different equidistant positions about the circumferential location of the orienting device.

17. The method of claim 14 wherein the first openings of the anchoring segment are of a slot configuration.

18. The method of claim 17 wherein the second openings of the orienting device are pairs of threaded orifices for accommodating the fasteners for the securing thereof.

19. The method of claim 18 wherein the fasteners are set screws.

20. The method of claim 14 further comprising:

aligning the window of the tubular with a window in a casing of a main bore; and installing hardware through the window in the tubular and the window in the casing and into a lateral bore emerging from the window in the casing.

* * * * *